US007438245B2

(12) United States Patent
Kawamoto et al.

(10) Patent No.: US 7,438,245 B2
(45) Date of Patent: Oct. 21, 2008

(54) MILLING AND CLASSIFYING APPARATUS, COLLISION MILL, AIR CLASSIFIER, TONER, AND METHOD FOR PRODUCING TONER

(75) Inventors: Masahiro Kawamoto, Sunto-gun (JP); Kohta Wakimoto, Sakai-gun (JP); Kohji Kubota, Sakai-gun (JP); Mamoru Kawaguchi, Numazu (JP); Yoshiyuki Okegawa, Fuji (JP); Hideyuki Ueda, Numazu (JP); Masayuki Kakimoto, Susono (JP); Hiroaki Sugiyama, Numazu (JP); Tomoyuki Yamada, Numazu (JP); Yuuichi Kohyama, Sakai-gun (JP); Masato Kobayashi, Sunto-gun (JP); Fumio Nishide, Sakai-gun (JP); Kenkoh Degura, Sakai-gun (JP); Hirofumi Yamanaka, Fukui (JP); Tohru Suganuma, Numazu (JP); Shoji Watanabe, Sakai-gun (JP); Ikuo Tasaki, Awara (JP)

(73) Assignee: Ricoh Company, Ltd., Tokyo (JP)

( * ) Notice: Subject to any disclaimer, the term of this patent is extended or adjusted under 35 U.S.C. 154(b) by 89 days.

(21) Appl. No.: 11/178,457

(22) Filed: Jul. 12, 2005

(65) Prior Publication Data

US 2006/0032952 A1 Feb. 16, 2006

(30) Foreign Application Priority Data

| | | |
|---|---|---|
| Jul. 13, 2004 | (JP) | 2004-205500 |
| Jul. 20, 2004 | (JP) | 2004-211214 |
| Jul. 12, 2005 | (JP) | 2005-203334 |
| Jul. 12, 2005 | (JP) | 2005-203508 |

(51) Int. Cl.

| | |
|---|---|
| ***B02B 1/00*** | (2006.01) |
| ***B02B 5/02*** | (2006.01) |
| ***B02C 11/08*** | (2006.01) |
| ***B02C 21/00*** | (2006.01) |

(52) U.S. Cl. ..... 241/40; 241/80; 241/97

(58) Field of Classification Search ..... 241/5, 241/40, 79.1, 80, 97

See application file for complete search history.

(56) References Cited

U.S. PATENT DOCUMENTS 3,693,791 A * 9/1972 Beck ..... 209/710

(Continued)

FOREIGN PATENT DOCUMENTS

EP 0 679 441 A2 11/1995

(Continued)

OTHER PUBLICATIONS

Patent Abstracts of Japan, JP 2004-073918, Mar. 11, 2004.

(Continued)

*Primary Examiner*—Bena Miller

(74) *Attorney, Agent, or Firm*—Oblon, Spivak, McClelland, Maier & Neustadt, P.C.

(57) ABSTRACT

Disclosed is a milling and classifying apparatus, adapted to produce toner fine particles, comprising a collision mill, and an air classifier, wherein the collision mill comprises a jet nozzle room, a path, a collision plate, and a collision member mounted to a support of the collision plate at downstream of the collision plate, the air classifier comprises a dispersion room and a classification room, the classification room is disposed below the dispersion room, and a flow stabilizer is arranged at a central suction of the separator core to control swirl stream generated within the classification room so as to centrifuge the powder into coarse particles and fine particles by action of the swirl stream.

28 Claims, 7 Drawing Sheets

U.S. PATENT DOCUMENTS

| | | | | |
|---|---|---|---|---|
| 4,266,673 | A * | 5/1981 | Haidlen et al. | 209/139.1 |
| 5,934,575 | A * | 8/1999 | Ohnishi et al. | 241/5 |
| 5,938,045 | A * | 8/1999 | Makino et al. | 209/713 |
| 6,103,440 | A | 8/2000 | Lohr | |
| 6,335,137 | B1 | 1/2002 | Suzuki et al. | |
| 2006/0032952 | A1 | 2/2006 | Kawamoto et al. | |

FOREIGN PATENT DOCUMENTS

| | | | |
|---|---|---|---|
| EP | 0 718 704 | A1 | 6/1996 |
| JP | 5-34977 | | 2/1993 |
| JP | 6-154708 | | 6/1994 |
| JP | 6-154709 | | 6/1994 |
| JP | 7-155697 | | 6/1995 |
| JP | 8-103685 | | 4/1996 |
| JP | 08173909 | A * | 7/1996 |
| JP | 2000-157933 | | 6/2000 |
| JP | 3090558 | | 7/2000 |
| JP | 3133100 | | 11/2000 |
| JP | 3182039 | | 4/2001 |
| JP | 2002-143775 | | 5/2002 |
| JP | 3336532 | | 8/2002 |

OTHER PUBLICATIONS

U.S. Appl. No. 11/561,220, filed Nov. 17, 2006, Kadota, et al.
U.S. Appl. No. 11/752,562, filed May 23, 2007, Kubota, et al.
U.S. Appl. No. 11/852,611, filed Sep. 10, 2007, Kinoshita, et al.
U.S. Appl. No. 12/047,460, filed Mar. 13, 2008, Suganuma.
U.S. Appl. No. 12/111,486, filed Apr. 29, 2008, Kinoshita, et al.

* cited by examiner

MILLING AND CLASSIFYING APPARATUS, COLLISION MILL, AIR CLASSIFIER, TONER, AND METHOD FOR PRODUCING TONER

BACKGROUND OF THE INVENTION

1. Field of the Invention

The present invention relates to a milling and classifying apparatus that is utilized to prepare toners for electrostatic images from coarse toner particles by use of high-pressure and high-velocity air stream; and a method for producing a toner, the resulting toner, a collision mill, an air classifier, and an apparatus and a method for producing fine particles.

2. Description of the Related Art

Toners are typically utilized for developing electrostatic latent images in image forming processes such as electrophotographic processes and electrostatic photography processes. In theses processes, toners are demanded to be fine particles, and are typically produced by way of melting and kneading a binder resin, a colorant agent such as dye and pigment, and a magnetic material to prepare a mixture, then cooling-solidifying, and milling-classifying the mixture.

With respect to processes for producing toner fine particles from toner coarse particles by means of collision mills in the prior art, Japanese Patent (JP-B) No. 3133100 discloses a secondary collision plate, which is mounted to a grinding room, and is detachable in relation to the velocity of jet stream; JP-B No. 3090558 discloses a jet mill in which the inner surface of the grinding room has the same solid angle with that of the outer surface of the conical member to which the coarse particles are clashed and milled; Japanese Patent Application Laid-Open (JP-A) No. 08-103685 discloses a jet mill that is equipped with an inner wall of milling room where the third grinding is performed after the second grinding; and Japanese Utility Model Application Publication (JP-Y) No. 07-25227 discloses a jet mill in which the surface of the collision plate is flat and perpendicular to the axis of the nozzle, and a conical projection is disposed on the collision plate and is aligned with the axis of the nozzle.

FIG. 1 shows a typical construction of conventional jet mills. As shown in FIG. 1, coarse toner particles A to be milled are fed from inlet 13 of collision mill 11 into injection nozzle 12. High pressure air B is fed into injection nozzle 12, thereby the coarse toner particles flow with the stream of the high pressure air under higher velocities, then collide with collision plate 15 and are milled into finer particles. The milled toner particles C travel between the support 16 of collision plate 15 and the inner wall of grinding room 14, then flow out from outlet 17.

Recently, there exist commercial needs to improve dot reproducibility for higher image quality and to enhance fixing property at lower temperatures for energy saving, thus the toners are demanded to be more fine in their particle size and more narrow in their particle size distribution. As for additive materials compounded into toners, resins with lower softening temperatures are employed that have lower softening temperatures, and waxes are also added so as to agree with oil-less apparatuses. Consequently, there arise problems that the toners are hardly milled into desired particle sizes and various adhesion and/or deposition tend to generate in the production and/or processing facilities.

However, the proposals on the base of milling and classifying apparatuses described above address either reducing the particle size or narrowing the particle size distribution, in general. Therefore, both of reducing the particle size and narrowing the particle size distribution inevitably lead to reduction of toner feed rate currently, which resulting in lower productivity and higher production cost.

In conventional processes, toner particles milled by means of collision mills are further classified in order to remove coarse particles as well as excessively fine particles, thereby toner particles are prepared with an intended particle size distribution. FIG. 2 exemplarily shows a conventional air classifier that utilizes pressurized gas and high velocity stream (e.g. JP-A No. 2002-143775).

As shown in FIG. 2, since the lower surface of center core 28 in classification room 24 presents substantially the same slope with that of the upper surface of separator core 26, the powder of toner particles tends to flow stably between the lower and upper surfaces as a circular path. Namely, the fine particles balanced for the centrifugal force and the centripetal force may reside at certain sites of the lower surface of center core 28 and the upper surface of separator core 26 while swirling on the circular path, thus such balanced particles tend to enlarge the apparent size due to coagulation with other particles, consequently coarse particles are likely to yield. When such coarse particles are present in a toner of final product, the toner cannot represent a narrow particle size distribution, and also the coarse particles are likely to be divided into extremely fine particles in the preceding processes, which often degrading image quality remarkably.

Moreover, such balanced particles have a tendency to deposit on the lower surface of center core 28 and/or on the upper surface of separator core 26, which may affect the optimum classifying condition due to the deformation of classification room 24. Incidentally, less output rate of toner particles may bring about a narrower particle size distributions in precise classifying processes owing to less coagulation of fine particles; however, the decreased output rate inevitably leads to raising the production cost.

JP-A No. 07-155697 discloses an air classifier base on Coanda effect, in which the classification accuracy is enhanced by way of a rounded outer edge of a center core in a classification room. JP-A No. 06-154708 discloses an air classifier for the purpose of enhancing the classification accuracy, in which a separator core is divided into a central portion and an outer guide and a certain space is provided between them, thereby free vortexes generate within the classification room. JP-A No. 05-34977 discloses a method of producing a toner for the purpose of enhancing the classification accuracy, in which a guide room is provided above the classification room, plural louvers are provided between the guide room and the classification room, and powder and air fed into the guide room flow into the classification room through between the louvers. JP-A No. 2000-157933 discloses a classifier for the purpose of enhancing the classification accuracy, in which a kinetic energy is applied to a powder through controlling the air stream within a dispersion room, thereby the powder is sufficiently dispersed within the dispersion room.

However, these proposals in the prior art are insufficient for satisfying production capacity as well as classification accuracy in terms of the requirements for toners that are utilized in developing electrostatic latent images currently. For example, in the classifier of JP-A No. 2000-157933 described above, the air stabilizer in the dispersion room tends to decrease the stabilization effect with time, since the divided particles have a tendency to coagulate again till the particles flow into the classification room at downstream.

SUMMARY OF THE INVENTION

Accordingly, it is an object of the present invention to provide a milling and classifying apparatus, equipped with a collision mill and an air classifier, which can produce toners having an extremely small particle size and an extremely narrow particle size distribution while reducing the content of coarse particles and maintaining the production capacity, thus the toners can provide higher image quality and can be fixed at lower temperatures.

The object of the present invention can be attained by the milling and classifying apparatus which comprises a collision mill equipped with collision member 38 attached to collision plate support 36 behind collision plate 35 and facing to the jet stream, as shown in FIG. 3, and an air classifier equipped with a flow stabilizer capable of controlling air flow by way of changing the width and/or height of the flow path between the upper surface and lower surface of the separator core.

The milling and classifying apparatus according to the present invention comprises a collision mill, and an air classifier, wherein the collision mill comprises a jet nozzle configured to eject jet stream into a milling room, a path configured to feed a powder to be milled into the jet stream, and a collision plate disposed opposite to the jet nozzle, a collision member is further mounted to a support of the collision plate at downstream of the collision plate, and the powder collides with the collision member following the collision with the collision plate, the air classifier comprises a dispersion room into which a mixture of primary air and the powder is introduced, and a classification room which is equipped with a center core at the upper side, a separator core at the lower side, and a secondary air inlet at the side wall, the classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream.

In the milling and classifying apparatus according to the present invention, the collision member mounted to the support of the collision plate bring about a decrease of pressure drop between the jet nozzle and the collision member and thus the air velocity slightly decreases at the region. Consequently, the particles with smaller particle sizes tend to lower the vector component of velocity toward the outlet owing to significant sensitivity to the decreased air velocity, thus the particles with lower particle sizes tend to flow between the collision member and the inner wall into the outlet without colliding with the collision member, therefore excessive milling that results in broad distribution can be prevented. On the other hand, the particles with larger particle sizes, in other words relatively heavy particles are hardly affected by the decreased air velocity in general, thus the particles with larger particle sizes tend to run straight and collide with the collision member then flow between the collision member and the inner wall into the outlet, as a result the particles with larger particle sizes can be divided selectively. By virtue of these effects, toners with a fine particle size and a narrow particle size distribution can be obtained.

Moreover, the air classifier, equipped with the flow stabilizer capable of controlling air flow by way of changing the width and/or height of the flow path between the upper surface and lower surface of the separator core, may eliminate the residence of swirling fine particles, which may lead to higher classification accuracy owing to decrease of coarse particles entering into the outlet, and thus toner products may be obtained with a narrower particle size distribution.

Preferably, the radius of the collision plate R (mm) and the distance from the collision plate to the collision member L (mm) satisfy the relation of $0.05<L/R<1.70$; the support of the collision plate is separable into plural parts so as to adjust the distance L (mm); the radius of the collision plate R (mm) and the height of the collision member from the support of the collision plate H (mm) satisfy the relation of $0.05<H/R<0.80$; the radius of the collision plate R (mm) and the thickness of the collision member D (mm) satisfy the relation of $0.04<D/R<0.80$.

Preferably, the collision member is formed of a ceramic material; the surface roughness Rmax of the collision member is 1.6 μm or less; the flow stabilizer is disposed within 500 mm from the inner wall of the central suction of the separator core in the radius direction of the central suction; the flow stabilizer is equipped with plural blades on a ring pedestal for controlling the air stream and a core-adjusting ring inside the pedestal for controlling the suction pressure at the central suction of the separator core; the space between the blades in the flow stabilizer is 0.1 mm to 50 mm.

Preferably, each blade in the flow stabilizer is folded in a perpendicular direction at a site more distant than the middle of the blade; the angle between the folded surface and unfolded surface of the folded blades in the flow stabilizer is from 90 degrees to 180 degrees; the angle and the space of the attached blades in the flow stabilizer are adjustable by a bolt mechanism, and the height and the thickness of the blades are adjustable by exchanging detachably the blades; the inner diameter of the suction of the flow stabilizer is adjustable by exchanging detachably the core-adjusting ring; the flow stabilizer is detachably attached by a mating mechanism.

In another aspect of the present invention, a method is provided for producing a toner by means of the milling and classifying apparatus according to the present invention.

In still another aspect of the present invention, a toner is provided that is produced by the method according to the present invention described above.

In still another aspect of the present invention, a collision mill is provided that comprises a jet nozzle configured to eject jet stream into a milling room, a path configured to feed a powder to be milled into the jet stream, and a collision plate disposed opposite to the jet nozzle, wherein a collision member is further mounted to a support of the collision plate at downstream of the collision plate, and the powder collides with the collision member following the collision with the collision plate.

Preferably, the radius of the collision plate R (mm) and the distance from the collision plate to the collision member L (mm) satisfy the relation of $0.05<L/R<1.70$; the support of the collision plate is separable into plural parts so as to adjust the distance L (mm); the radius of the collision plate R (mm) and the height of the collision member from the support of the collision plate H (mm) satisfy the relation of $0.05<H/R<0.80$; the radius of the collision plate R (mm) and the thickness of the collision member D (mm) satisfy the relation of $0.04<D/R<0.80$; the collision member is formed of a ceramic material; the surface roughness Rmax of the collision member is 1.6 μm or less.

In still another aspect of the present invention, a method is provided for producing a toner by means of the collision mill according to the present invention.

In still another aspect of the present invention, a toner is provided that is produced by the method according to the present invention described above.

In still another aspect of the present invention, an air classifier is provided that comprises a dispersion room into which a mixture of primary air and the powder is introduced, and a classification room which is equipped with a center core at the upper side, a separator core at the lower side, and a secondary air inlet at the side wall, wherein the classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream.

Preferably, the flow stabilizer is disposed within 500 mm from the inner wall of the central suction of the separator core in the radius direction of the central suction; the flow stabilizer is equipped with plural blades on a ring pedestal for controlling the air stream and a core-adjusting ring inside the pedestal for controlling the suction pressure at the central suction of the separator core; the space between the blades in the flow stabilizer is 0.1 mm to 50 mm; each blade in the flow stabilizer is folded in a perpendicular direction at a site more distant than the middle of the blade; the angle between the folded surface and unfolded surface of the folded blades in the flow stabilizer is from 90 degrees to 180 degrees; the angle of the attached blades in the flow stabilizer is adjustable by a bolt mechanism; the space of the attached blades in the flow stabilizer is adjustable by a bolt mechanism; the height of the blades in the flow stabilizer is adjustable by exchanging detachably the blades; the thickness of the blades in the flow stabilizer is adjustable by exchanging detachably the blades; the width of the blades in the flow stabilizer is adjustable by exchanging detachably the blades; the inner diameter of the suction of the flow stabilizer is adjustable by exchanging detachably a core-adjusting ring; the flow stabilizer is detachably attached by a mating mechanism; the powder has an average particle size of 5.0 μm to 13.0 μm.

In still another aspect of the present invention, an apparatus for producing fine particles is provided that comprises an air classifier, and at least one of grinding mills, collision mills, and air conveyors, wherein the air classifier is one according to the present invention described above.

In still another aspect of the present invention, a method is provided for producing fine particles by means of the apparatus for producing fine particles according to the present invention. Preferably, the fine particles are a toner.

DESCRIPTION OF THE PREFERRED EMBODIMENTS (Milling and Classifying Apparatus)

The milling and classifying apparatus according to the present invention comprises a collision mill, an air classifier, and the other components and/or parts depending on requirements.

The collision mill comprises a jet nozzle configured to eject jet stream into a milling room, a path configured to feed a powder to be milled into the jet stream, a collision plate disposed opposite to the jet nozzle, and the other parts and/or members depending on requirements. Further, a collision member is mounted to a support of the collision plate at downstream of the collision plate, and the particles of the powder collide with the collision member following the collision with the collision plate.

The air classifier comprises a dispersion room into which a mixture of primary air and the powder is introduced, and a classification room which is equipped with a center core at the upper side, a separator core at the lower side, and a secondary air inlet at the side wall, and the other components and/or parts depending on requirements.

The classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream.

Figure 5:
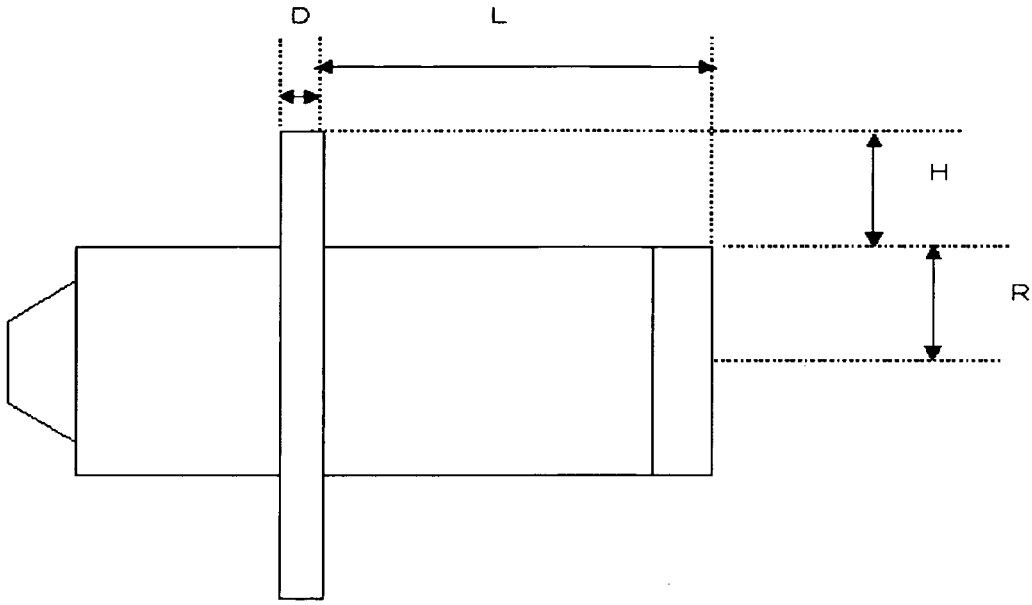
FIG. 5 is a schematic cross section that indicates various sizes in terms of a collision plate and a collision member in the present invention.

Preferably, the radius of the collision plate R (mm) and the distance from the collision plate to the collision member L (mm) satisfy the relation of $0.05<L/R<1.70$, more preferably is $0.15<L/R<1.50$, and still more preferably is $0.20<L/R<1.30$ (see FIG. 5).

When $0.05\leqq L/R$, the difference of selectivity to fine particles and to coarse particles is insufficient in the classifying performance, thus the particle size hardly takes narrower distribution, and when $1.70\leqq L/R$, both of fine particles and coarse particles tend to flow through without collision with the collision member although the difference of vector components is magnified. The above described range of L/R may suppress the excessive milling against fine particles and promote the selective milling against coarse particles, thus resulting in narrower particle size distribution.

Figure 6:
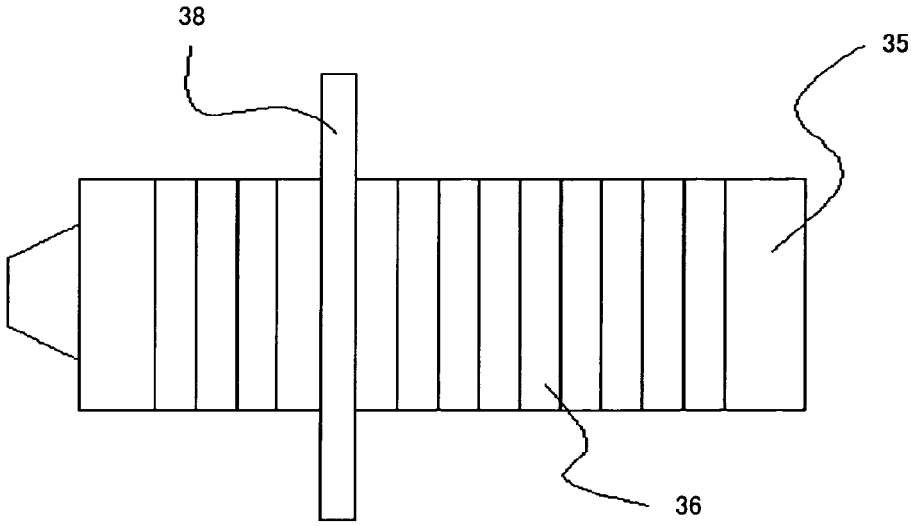
FIG. 6 is a schematic cross section that exemplarily shows a collision plate support that is separable into disc-like parts, a collision plate, and a collision member utilized in the present invention.

Preferably, the support of the collision plate is separable into plural parts so as to adjust the distance L (mm). Namely, the optimum condition of L/R varies depending on toner grades, therefore, L/R should be inherently adjusted for the specific grade within the range of $0.05<L/R<1.70$. When the collision plate is separable into plural parts as shown in FIG. 6, the distance L can be easily adjusted to a desirable level, which allows shortening of operating period to respond to possible grade changes.

Preferably, the radius of the collision plate R (mm) and the height of the collision member from the support of the collision plate H (mm) satisfy the relation of $0.05<H/R<0.80$, more preferably is $0.10<H/R<0.45$, and still more preferably is 0.12<H/R<0.40 (see FIG. 5). When H/R≦0.05, the collision area is insufficient; and when H/R≧0.80, the air velocity decreases still further between the jet nozzle and the collision member and thus the coarse particles decrease the velocity, which leads to insufficient collision of coarse particles at the collision member. The above described range of H/R may suppress the excessive milling against fine particles and promote the selective milling against coarse particles, thus resulting in narrower particle size distribution.

Preferably, the radius of the collision plate R (mm) and the thickness of the collision member D (mm) satisfy the relation of 0.04<D/R<0.80, more preferably is 0.08<D/R<0.60, and still more preferably is 0.10<L/R<0.55. When 0.04<D/R, the collision member is less likely to deform under prolonged continuous operation owing to sufficient mechanical strength; and when D/R≧0.80, the air velocity decreases still further between the jet nozzle and the collision member and thus the coarse particles decrease the velocity, which leads to insufficient collision of coarse particles at the collision member. The preferable range of D/R described above may suppress the excessive milling against fine particles and promote the selective milling against coarse particles, thus resulting in narrower particle size distribution.

Preferably, the flow stabilizer is disposed within 500 mm from the center of the central suction of the separator core, thereby appropriate control of swirl flow may be obtained without disturbing the swirl flow, thus resulting in higher classification accuracy. When the site of the flow stabilizer is over 500 mm from the inner wall, the swirl flow may be adversely disturbed significantly.

Preferably, the flow stabilizer is equipped with plural blades on a ring pedestal for controlling the air stream and a core-adjusting ring inside the pedestal for controlling the suction pressure at the central suction of the separator core. When the particle size distribution is changed for the particles to be classified, the cut point of classification should be altered correspondingly. The core-adjusting ring for adjusting the suction pressure allows shortening the operating period.

Preferably, the space between the blades in the flow stabilizer is 0.1 mm to 50 mm, thereby the classification accuracy may be enhanced still more. When the space is more than 50 mm, the swirl velocity is lower at the central area of the swirl stream, possibly resulting in insufficient classification.

Preferably, each blade in the flow stabilizer is folded in a perpendicular direction at a site more distant than the middle of the blade, thereby the classification accuracy may be enhanced still more. When the folded site is in front of the blade center, the swirl stream turns excessively toward the central portion, possibly resulting in insufficient classification.

Preferably, the angle between the folded surface and unfolded surface of the folded blades in the flow stabilizer is from 90 degrees to 180 degrees, thereby the classification accuracy may be enhanced still more. When the angle between the folded surface and unfolded surface is above 180 degrees, the blade tends to resist against the air stream, possibly resulting in significant disturbance of swirl stream.

Preferably, the collision member is formed of a ceramic material, thereby the abrasion resistance of the collision member may be remarkably enhanced.

Preferably, the surface roughness Rmax of the collision member is processed as smooth as 1.6 μm or less, thereby the toner deposition may be reduced even in a continuous operation, resulting in improved maintenance such as shortened period for cleaning the deposited toner. The collision member may be polished into a mirror surface by buff polishing, for example.

Preferably, the angle and the space of the attached blades in the flow stabilizer are adjustable by a bolt mechanism, and the height and the thickness of the blades are adjustable by exchanging detachably the blades, thereby the flow stabilizer may be optimized corresponding to the desired particle size distribution.

Preferably, the inner diameter of the suction of the flow stabilizer is adjustable by exchanging detachably the core-adjusting ring, thereby the inner diameter of the suction may be optimized corresponding to the desired particle size distribution.

Preferably, the flow stabilizer is detachably attached by a mating mechanism, thereby the maintenance may be improved such that the period for cleaning the deposited toner is shortened.

Figure 12:
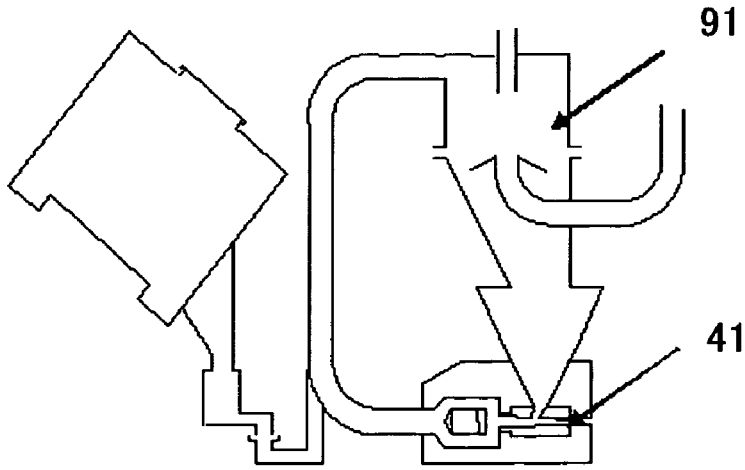
FIG. 12 is a schematic view that exemplarily shows a milling and classifying apparatus according to the present invention.

The milling and classifying apparatus described above is exemplified by the apparatus shown schematically in FIG. 12.

(Collision Mill)

The collision mill according to the present invention comprises a jet nozzle configured to eject jet stream into a milling room, a path configured to feed a powder to be milled into the jet stream, and a collision plate disposed opposite to the jet nozzle, wherein a collision member is further mounted to a support of the collision plate at downstream of the collision plate, and the powder collides with the collision member following the collision with the collision plate.

Preferably, the radius of the collision plate R (mm) and the distance from the collision plate to the collision member L (mm) satisfy the relation of 0.05<L/R<1.70, more preferably is 0.15<L/R<1.50, and still more preferably is 0.20<L/R<1.30 (see FIG. 5).

When 0.05≧L/R, the difference of selectivity to fine particles and to coarse particles is insufficient for appropriate classification, thus the particle size hardly takes narrower distribution, and when 1.70≦L/R, both of fine particles and coarse particles tend to flow through without collision with the collision member although the difference of vector components is magnified. The above described range of L/R may suppress the excessive milling against fine particles and promote the selective milling against coarse particles, thus resulting in narrower particle size distribution.

Preferably, the support of the collision plate in the collision mill is separable into plural parts so as to adjust the distance L (mm) easily. Namely, the optimum condition of L/R varies depending on toner grades, therefore, L/R should be inherently adjusted for a specific grade within the range of 0.05<L/R<1.70. When the collision plate is separable into plural parts as shown in FIG. 6, the distance L can be easily adjusted into a desirable level, which allows shortening of operating period in grade change.

Preferably, the radius of the collision plate R (mm) and the height of the collision member from the support of the collision plate H (mm) satisfy the relation of 0.05<H/R<0.80, more preferably is 0.10<H/R<0.45, and still more preferably is 0.12<H/R<0.40 (see FIG. 5). When H/R≦0.05, the collision area is insufficient for appropriate collision, and when H/R≧0.80, the air velocity decreases still further between the jet nozzle and the collision member and thus the coarse particles decrease the velocity at the region, which leads to insufficient collision of coarse particles with the collision member. The above described range of H/R may suppress the excessive milling against fine particles and promote the selective milling against coarse particles, thus resulting in narrower particle size distribution.

Preferably, the radius of the collision plate R (mm) and the thickness of the collision member D (mm) satisfy the relation of 0.04<D/R<0.80, more preferably is 0.08<D/R<0.60, and still more preferably is 0.10<L/R<0.55. When 0.04<D/R, the collision member is less likely to deform under prolonged continuous operation owing to sufficient mechanical strength, and when D/R≧0.80, the air velocity decreases still further between the jet nozzle and the collision member and thus the coarse particles decrease the velocity at the region, which leads to insufficient collision of coarse particles at the collision member. The above described range of D/R may suppress the excessive milling against fine particles and promote the selective milling against coarse particles, thus resulting in narrower particle size distribution.

The collision mill according to the present invention is defined as mills that can induce solid particles to collide with a solid material by action of high-speed gas stream such as high-speed air thereby can reduce the size of the solid particles. Accordingly, so-called jet mills and jet atomizers that are commercially utilized to divide solid particles into smaller solid particles are embraced into the concept of the collision mill according to the present invention.

The velocity of gas stream at the outlet of the gas nozzle is preferably 50 to 350 m/sec, more preferably is 100 to 300 m/sec.

Figure 4:
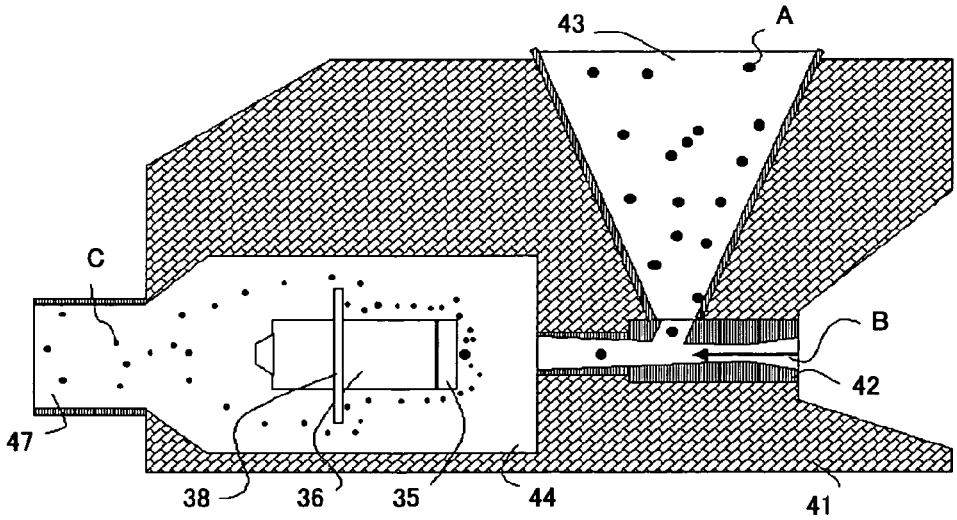
FIG. 4 is a schematic cross section that exemplarily shows a milling and classifying apparatus to which a collision member is attached according to the present invention.

FIG. 4 shows an exemplary construction of a milling and classifying apparatus. As shown in FIG. 4, toner A of coarse particles to be milled is fed to injection nozzle 42 from the raw material inlet 43 disposed at upper side of the collision mill 41. By action of high-velocity stream B ejected from nozzle 42, the toner of coarse particles flows with stream B at high velocity, and collides against opposing collision plate 35 thereby is divided into fine particles. The toner of fine particles C, divided by the collision with the collision plate, flows between collision plate support 36 of column or cylinder shape and the inner wall of milling room 44, and on the way collide with flame-like collision member 38 of which the face is perpendicular to the support axis, and is further divided, then flow into outlet 47.

The face of collision member 38 is not necessarily required to be perpendicular to the support axis; for example, the face of collision member 38 may be somewhat inclined within about 10 degrees from the direction perpendicular to the support axis.

(Air Classifier)

The air classifier according to the present invention comprises a dispersion room into which a mixture of primary air and the powder is introduced, and a classification room which is equipped with a center core at the upper side, a separator core at the lower side, and a secondary air inlet at the side wall, wherein the classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream.

Preferably, the flow stabilizer is disposed within 500 mm from the center of the central suction of the separator core, thereby appropriate control of swirl flow may be obtained without disturbing the swirl flow, thus resulting in higher classification accuracy. When the site of the flow stabilizer is over 500 mm from the inner wall, the swirl flow may be adversely disturbed significantly.

Preferably, the flow stabilizer is equipped with plural blades on a ring pedestal for controlling the air stream and a core-adjusting ring inside the pedestal for controlling the suction pressure at the central suction of the separator core. When the particle size distribution is changed for the particles to be classified, the cut point of classification should be altered correspondingly. The core-adjusting ring for adjusting the suction pressure allows shortening the operating period.

Preferably, the space between the blades in the flow stabilizer is 0.1 mm to 50 mm, thereby the classification accuracy may be enhanced still more. When the space is more than 50 mm, the swirl velocity is lower at the central area of the swirl stream, possibly resulting in insufficient classification.

Preferably, each blade in the flow stabilizer is folded in a perpendicular direction at a site more distant than the middle of the blade, thereby the classification accuracy may be enhanced still more. When the folded site is in front of the blade center, the swirl stream turns excessively toward the central portion, possibly resulting in insufficient classification.

Preferably, the angle between the folded surface and unfolded surface of the folded blades in the flow stabilizer is from 90 degrees to 180 degrees, thereby the classification accuracy may be enhanced still more. When the angle between the folded surface and unfolded surface is above 180 degrees, the blade tends to resist against the air stream, possibly resulting in significant disturbance of swirl stream.

Preferably, the collision member is formed of a ceramic material, thereby the abrasion resistance of the collision member may be remarkably enhanced.

Preferably, the surface roughness Rmax of the collision member is processed as smooth as 1.6 μm or less, thereby the toner deposition may be reduced even in a continuous operation, resulting in improved maintenance such as shortened period for cleaning the deposited toner. The collision member may be polished into a mirror surface by buff polishing, for example.

Preferably, the angle and the space of the attached blades in the flow stabilizer are adjustable by a bolt mechanism, and the height and the thickness of the blades are adjustable by exchanging detachably the blades, thereby the flow stabilizer may be optimized corresponding to the desired particle size distribution.

Preferably, the inner diameter of the suction of the flow stabilizer is adjustable by exchanging detachably the core-adjusting ring, thereby the inner diameter of the suction may be optimized corresponding to the desired particle size distribution.

Preferably, the flow stabilizer is detachably attached by a mating mechanism, thereby the maintenance may be improved such that the period for cleaning the deposited toner is shortened.

Figure 1:
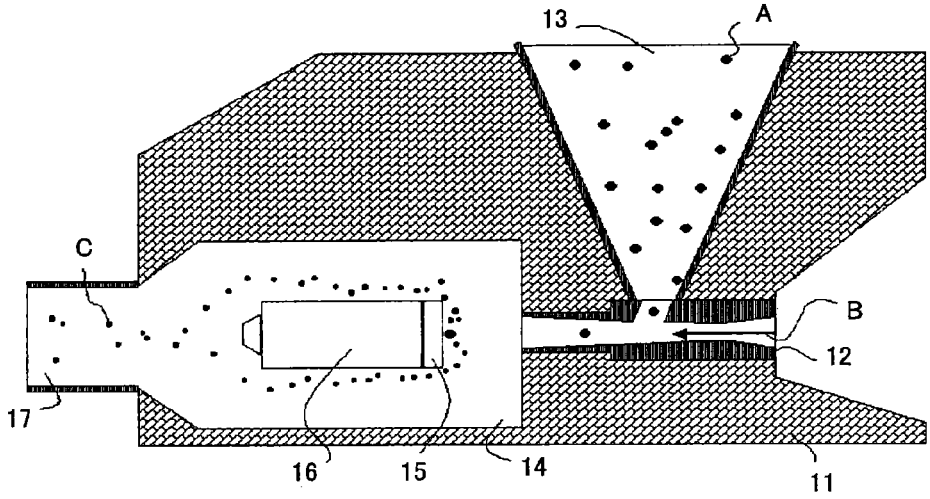
FIG. 1 PRIOR ART
FIG. 1 is a schematic cross section that exemplarily shows a conventional construction of collision mills in the prior art.
Figure 2:
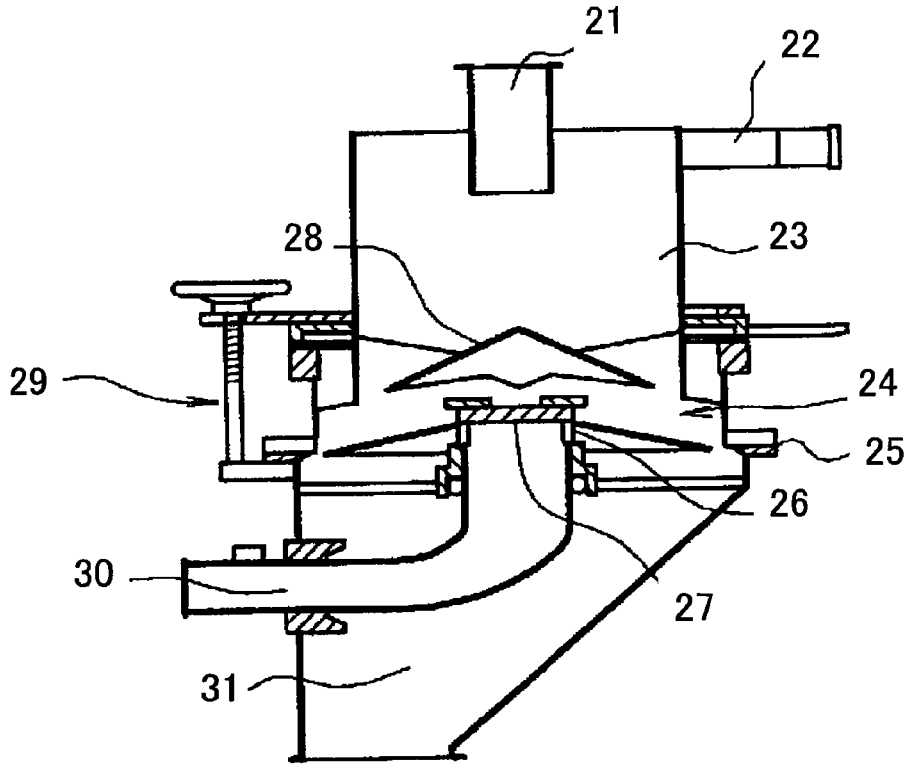
FIG. 2 PRIOR ART
FIG. 2 is a schematic cross section that exemplarily shows a conventional construction of air classifiers in the prior art.
Figure 3:
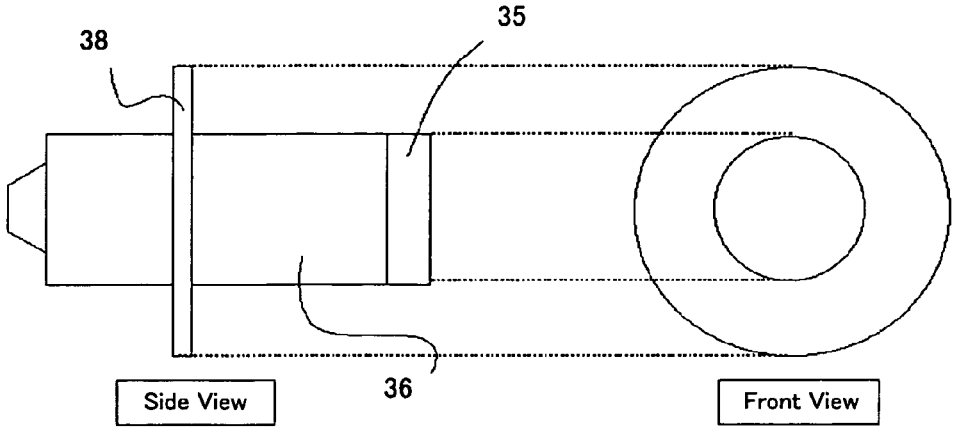
FIG. 3 is a schematic view that exemplarily shows a collision member in the present invention.

FIG. 2 shows an exemplary air classifier in the prior art. In FIG. 2, reference numbers 21 to 31 indicate as follows, 21: air duct, 22: powder feed pipe, 23: casing, 24: classification room, 25: secondary air inlet, 26: separator core, 27: central suction, 28: center core, 29: clamp, 30: fine particle outlet, and 31: coarse particle outlet.

One of the futures according to the present invention is that a flow stabilizer is provided at central suction 27 in order to control the circular flow within the classification room.

Figure 7:
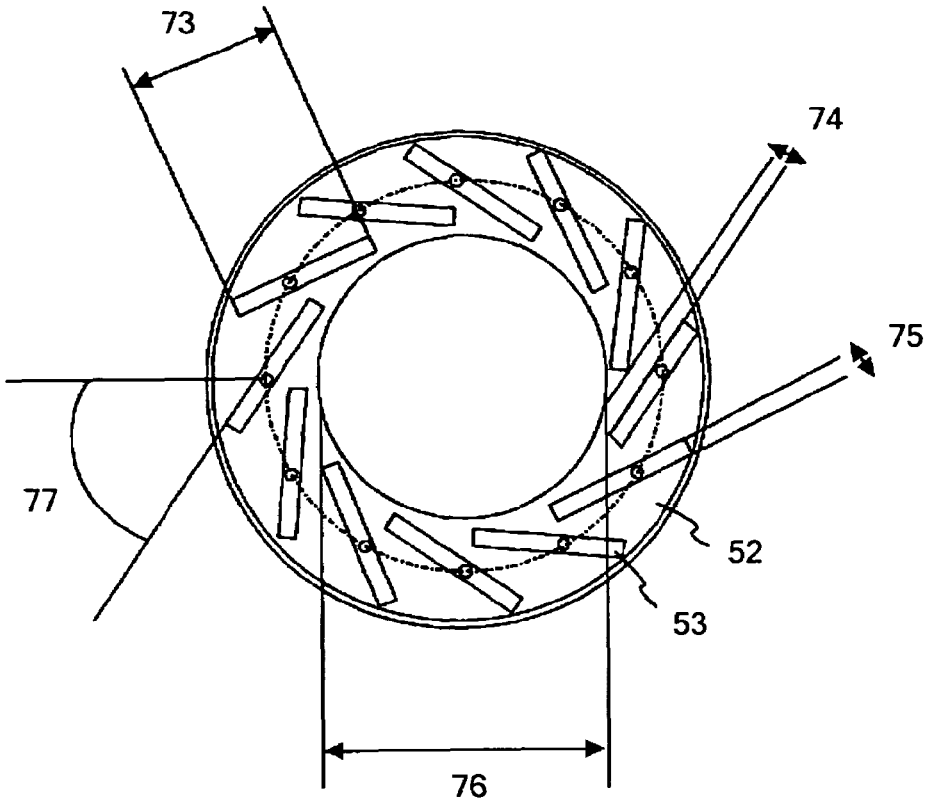
FIG. 7 is a schematic cross section of an exemplary flow stabilizer utilized in the present invention.

FIG. 7 is a schematic cross section of an exemplary flow stabilizer utilized in the present invention. As shown in FIG. 7, the flow stabilizer is equipped with plural blades 53 on ring pedestal 52 for controlling gas stream. Pedestal 52 is engaged with central suction 27 (FIG. 2) of the separator core by means of a screw mechanism.

In FIG. 7, the reference numbers indicate as follows, 73: blade width, 74: blade space, 75: blade thickness, 76: inner diameter of pedestal, and 77: angle of attached blade. Pedestal 52 is fitted into central suction 27 (FIG. 2) of the separator core, thus the inner diameter of central suction 27 is reduced into the inner diameter of pedestal 52.

A core-adjusting ring for controlling suction pressure may be detachably attached to the inside of pedestal 52 by means of bolts, which allows to alter the substantial diameter of central suction 27; namely, attachment and detachment of the core-adjusting ring may bring about decrease and increase of the inner diameter or core diameter 76 of the central suction, which also allows to control the suction pressure.

Figure 8:
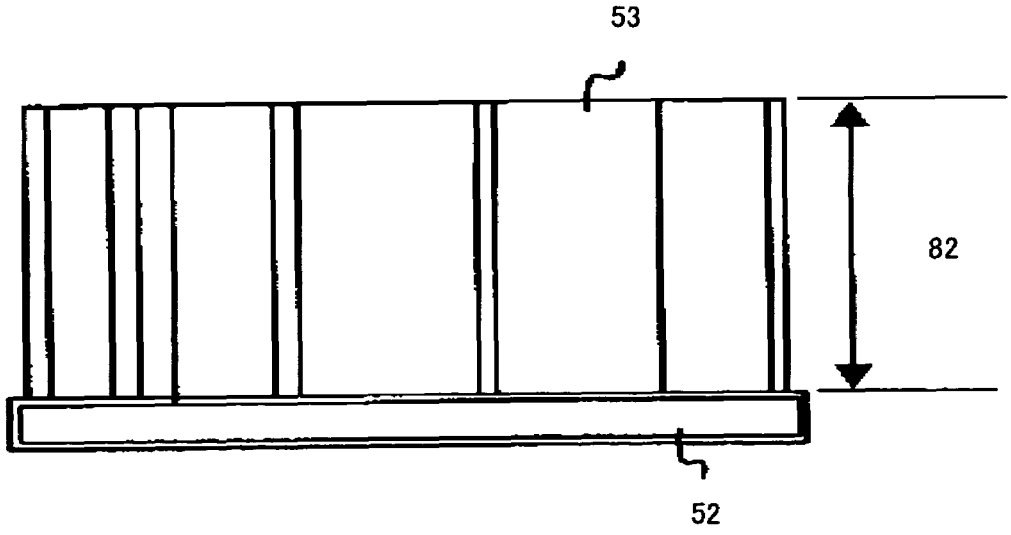
FIG. 8 is a schematic vertical section of an exemplary flow stabilizer utilized in the present invention.
Figure 9:
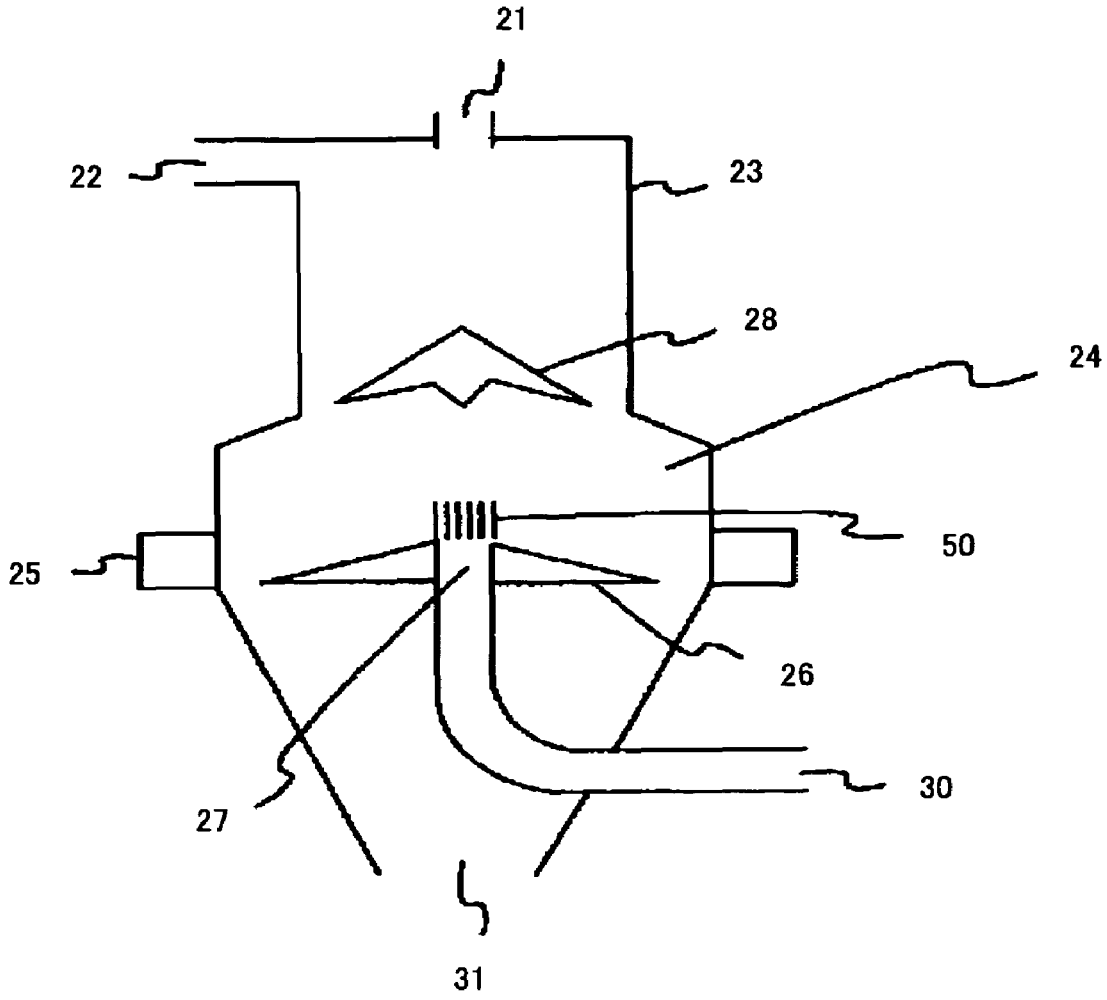
FIG. 9 is a schematic cross section of an exemplary air classifier according to the present invention.

FIG. 8 is a schematic vertical section of an exemplary flow stabilizer utilized in the present invention, in which 52 indicates the pedestal, 53 indicates the blade, and 82 indicates the height of the flow stabilizer. FIG. 9 is a schematic cross section of an exemplary air classifier according to the present invention, in which flow stabilizer 50 is mounted to central suction 27 of separator core 26. The other reference numbers indicate as follows, 21: air duct, 22: powder feed pipe, 23: casing, 24: classification room, 25: secondary air inlet, 28: center core, 30: fine particle outlet, and 31: coarse particle outlet.

Figure 10:
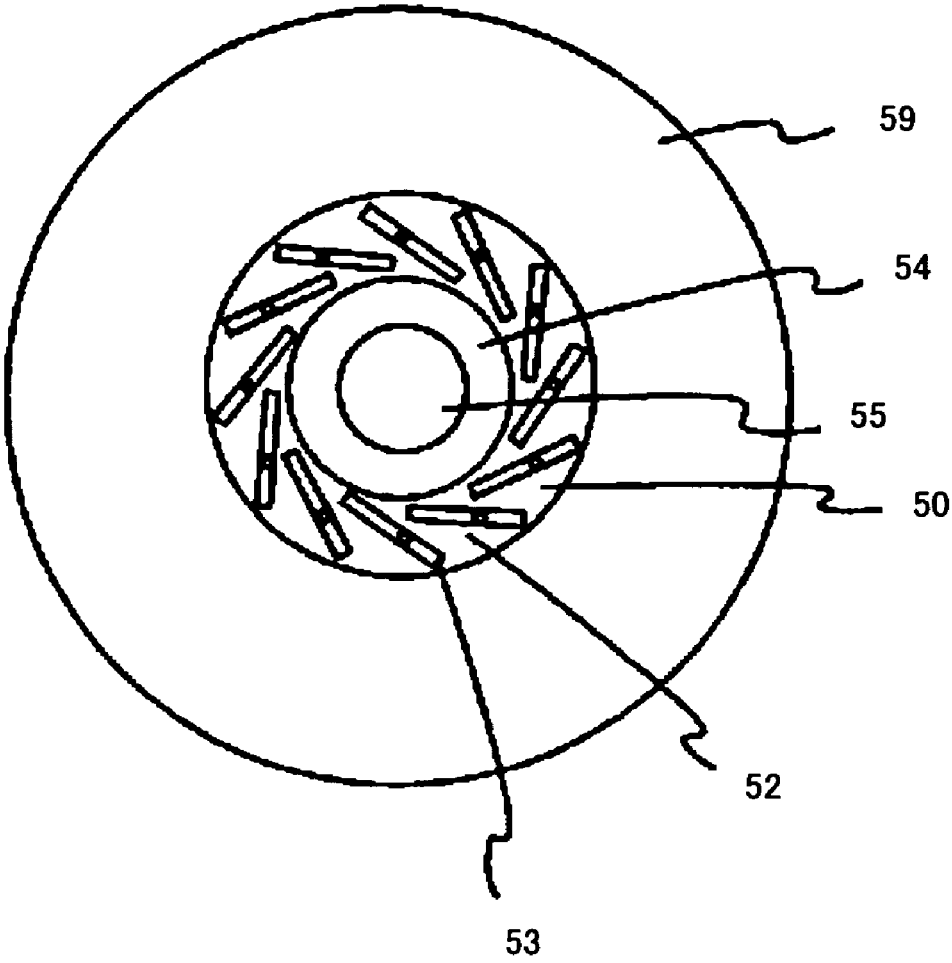
FIG. 10 is a schematic cross section of a separator core and a flow stabilizer classifier disposed concentrically.
Figure 11:
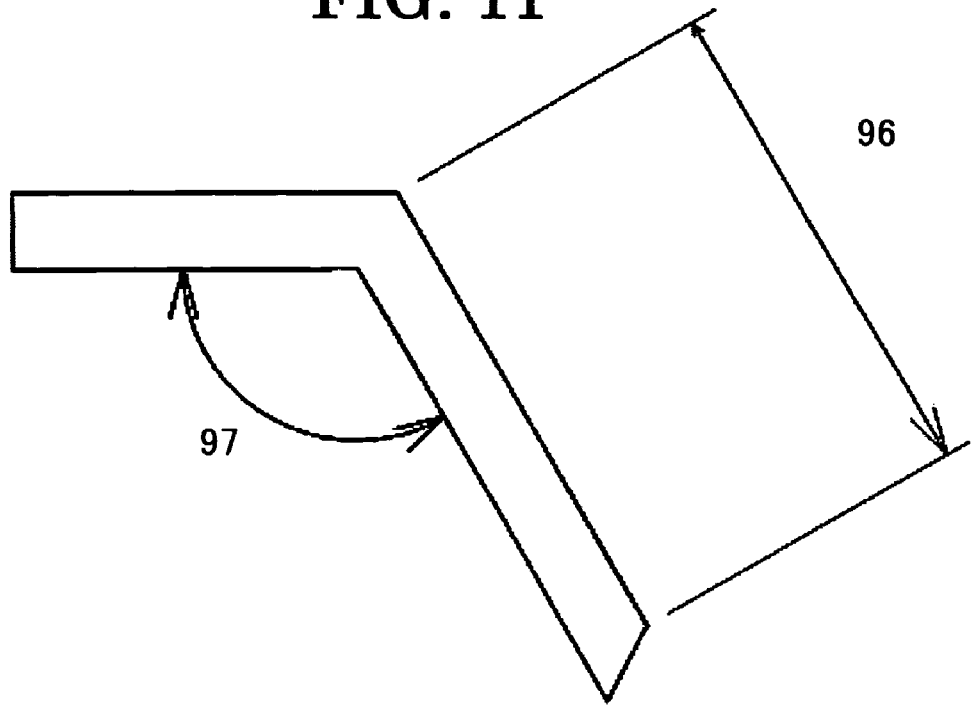
FIG. 11 is a schematic plan view of a blade utilized in an air stabilizer in the present invention.

FIG. 10 is a schematic cross section of separator core 59 and flow stabilizer 50 disposed at central suction 27 (FIG. 9). In FIG. 10, the reference numbers indicate as follows, 52: pedestal, 53: blade, 54: core-adjusting ring, and 55: core. The inner diameter of the core can be reduced through attachment of core-adjusting ring 24. FIG. 11 shows a blade which is folded into angle 97 at distance 96 from the edge. Various blades may be prepared with various folded angles and exchanged depending on requirements.

An air classifier according to the present invention will be exemplarily explained with reference to FIG. 9. Air duct 21 is provided at the top of casing 23, and powder feed pipe 22 is provided at the upper side wall of casing 23 for feeding the mixture of primary air and the powder. Coarse particle outlet 31 is provided at the bottom of the lower casing which also serves as a hopper of accumulated powder. Preferably, the lower casing is detachably attached to the upper casing by means of a clamp mechanism (not shown). Conical separator core 26 is disposed concentrically with center core 28 at above the coarse particle outlet 31 and beneath the center core 28, and classification room 24 is provided at the space between separator core 26 and center core 28. Fine particle outlet 30 is disposed below the center of separator core 26. Flow stabilizer 50 is mounted to central suction 27 of conical separator core 26.

Blades 53 of flow stabilizer 50 are separable from pedestal 52, and the blade angle 97, blade space 74, blade width 73, blade thickness 75, blade height 82, and inner diameter of core 76, and the like may be designed wide-variously, which allows to classify toners with significantly high accuracy by selecting an optimum condition.

(Toner and Process for Producing the Same)

The method for producing a toner according to the present invention produces a toner using one of milling and classifying apparatuses, collision mills, and air classifiers according to the present invention.

The toners according to the present invention may be produced by the method for producing a toner according to the present invention.

The raw materials for the toner may be properly selected depending on the application; examples of the raw materials include binder resins, colorants, releasing agents, charge control agents, inorganic fine powders, and the like.

The binder resin may be properly selected from conventional ones such as vinyl resins, polyester resins, polyol resins, and the like depending on the application.

Examples of vinyl resins include styrene mono-polymers such as polystyrenes, poly-p-chlorostyrenes, polyvinyltoluenes, and other polymers of styrene and substituted styrenes; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-chloromethylmethacrylate copolymers, styrene-acrylonitrile copolymers, styrene-vinylmethylether copolymers, styrene-vinylethylether copolymers, styrene-vinylmethylketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; polymethyl methacrylate, polybutyl methacrylate, polyvinyl chloride, and polyvinyl acetate. These resins may be used alone or in combination.

The polyester resins for binder resins described above may be synthesized from divalent alcohols, dibasic acids, alcohols and carboxylic acids having three or more functionalities, and the like shown below.

Examples of the divalent alcohols include ethylene glycol, triethylene glycol, 1,2-propylene glycol, 1,3-propylene glycol, 1,4-butanediol, neopentyl glycol, 1,4-butenediol, 1,4-bis(hydroxylmethyl)cyclohexane, bisphenol A, hydrogenated bisphenol A, polyoxyethylene bisphenol A, polyoxypropylene(2,2)-2,2'-bis(4-hydroxyphenyl)propane, polyoxypropylene(3,3) -2,2-bis(4-hydroxyphenyl)propane, polyoxyethylene(2,0)-2,2-bis(4-hydroxyphenyl)propane, and polyoxypropylene(2,0)-2,2'-bis(4-hydroxyphenyl)propane.

Examples of the dibasic acids include maleic acid, fumaric acid, mesaconic acid, citraconic acid, itaconic acid, glutaconic acid, phthalic acid, isophthalic acid, terephthalic acid, cyclohexane-dicarboxylic acid, succinic acid, adipic acid, sebacic acid, malonic acid, linolenic acid; anhydrides of the above acids; and esters of the above acids and lower alcohols.

Examples of alcohols and carboxylic acids having three or more functionalities include glycerin, trimethylolpropane, and pentaerythritol; and polycarboxylic acids having three or more carboxyl groups such as trimellitic acid and pyromellitic acid.

The polyol resins described above may be prepared by allowing the following components to react epoxy resins, with alkylene oxide adduct of dihydric phenol or glycidyl ether of the alkylene oxide adduct, compounds having in the molecule thereof one active hydrogen atom which is capable of reacting with epoxy group, and compounds having in the molecule thereof two or more active hydrogen atoms which are capable of reacting with epoxy group.

The binder resin described above may contain another resin depending on requirements in order to improve processing ability, for example. The additional resin may be selected from epoxy resins, polyamide resins, urethane resins, phenol resins, butyral resins, rosin resins, modified-rosin resins, and terpene resins. Specific examples of the epoxy resins may be polycondensate of bisphenols such as bisphenol A, bisphenol F, and epichlorohydrin.

The colorants may be properly selected depending on the application, examples thereof include black, yellow, orange, red, violet, blue, and green pigments, and the like.

Examples of the black pigments include carbon blacks such as oil furnace black, channel black, lamp black, and acetylene black; azine dyes such as aniline black, azo dyes of metal salts, metal oxides, complex metal oxides, and the like.

Specific examples of yellow pigment include Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake.

Specific examples of the orange pigment include Molybdate Orange, Permanent Orange GTR, Pyrazolone Orange, Vulcan Orange, Indanthrene Brilliant Orange RK, Benzidine Orange G, and Indanthrene Brilliant Orange GK.

Specific examples of the red pigment include red iron oxide, Cadmium Red, Permanent Red 4R, Lithol Red, Pyrazolone Red, Watchung Red Calcium Salt, Lake Red D, Brilliant Carmine 6B, Eosine Lake, Rhodamine Lake B, Alizarine Lake, and Brilliant Carmine 3B.

Specific examples of the purple pigment include Fast Violet B and Methyl Violet Lake.

Specific examples of the blue pigment include Cobalt Blue, Alkali Blue, Victoria Blue Lake, Phthalocyanine Blue, metal-free Phthalocyanine Blue, partially chlorinated Phthalocyanino Blue, Fast Sky Blue, and Indanthrene Blue BC.

Specific examples of the green pigment include Chrome Green, chromium oxide, Pigment Green B, and Malachite Green Lake.

These pigments may be used alone or in combination.

The amount of the colorants may be properly selected depending on the application; preferably, the amount of the pigment is 0.1 to 50 parts by mass based on 100 parts by mass of the binder resin.

Examples of the releasing agent include synthetic waxes such as polyethylene with a lower molecular weight, polypropylene with a lower molecular weight, and copolymers thereof; vegetable waves such as candelilla wax, carnauba wax, rice wax, wood wax, and jojoba wax; animal wax such as beeswax, lanolin, and whale oil; mineral wax such as montan wax and ozokerite; wax of fats and oils such as hydrogenated castor oil, hydroxy stearic acid, fatty amide, and phenol fatty ester. Among these, carnauba wax and polypropylene are preferable in particular.

The charge control agent, for control the toner into positive charge, may be nigrosine or quaternary ammonium salt thereof, metal complexes or salts of imidazole, or the like. The charge control agent, for control the toner into negative charge, may be metal complexes or salts of salicylic acid, organic boron salts, calix arene compounds, or the like.

Preferably, an inorganic fine powder is added to the toner utilized in the present invention in order to enhance the fluidity of the toner. A specific additional inorganic powder is often effective to provide a toner with superior fluidity and higher durability, especially with regard to the toner adapted to the present invention that has a relatively small particle size and contains a releasing agent.

Examples of the inorganic powder serving to enhance the fluidity of the toner are oxides and composite oxides comprising Si, Ti, Al, Mg, Ca, Sr, Ba, In, Ga, Ni, Mn, W, Fe, Co, Zn, Cr, Mo, Cu, Ag, V, and Zr. Among these, fine powders of silicon dioxide or silica, titanium dioxide or titania, and aluminum oxide or alumina are particularly preferable for the present invention.

Preferably, the inorganic powder described above is surface-treated to make them hydrophobic. Examples of surface treatment agents for making the inorganic powders include dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, alpha-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyltris(beta-methoxyethoxy)silane, gamma-methacryloxypropyltrtmethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, and hexatolyldisilazane. In addition, a titanate based coupling agent and an aluminum based coupling agent may also be employed.

Preferably, the content of the inorganic fine powder is of 0.1% by mass to 2% by mass based of the entire mass of the toner. When the content is less than 0.1% by mass, aggregation of toner particles may not be effectively prevented, and when the content is more than 2% by mass, the toner particles tend to scatter between thin line images, the inside of the image forming apparatus tends to be stained with the toner particles, and photoconductors are often scratched or abraded with the inorganic powder.

In addition, conventional or popular additives described later may be incorporated into the toner depending on the application, for example, fluidizing agents such as colloidal silica, abrasive materials such as titanium oxide, aluminum oxide, and silicon carbide, and lubricant such as metal salts of fatty acids.

The other additive may be lubricant powders such as polytetrafluoroethylene fluorine-resin powder, zinc stearate powder, and polyvinylidene fluoride, abrasive materials such as cerium oxide powder and strontium titanate, and conductivity-imparting materials such as carbon black, zinc oxide powder, and tin oxide powder. Furthermore, white or black fine particles having a traverse polarity may be added in a small amount to improve developing property.

The production process of toners will be explained in the following.

Initially, predetermined plural materials are weighed and mixed. The mixer may be selected from double-cone mixers, V-type mixers, drum mixers, super mixers, Henschel mixers, and Nauter mixers, then the mixture is kneaded. The kneading of the mixture may be carried out in a discontinuous manner by use of pressure kneaders, Banbury mixers, or twin rolls, for example. Preferably, the kneading is carried out in a continuous manner from the viewpoint of productivity by use of a single-screw or double screw extruder. Examples of the extruder include Model KTK double screw extruder (by Kobe Steel, Ltd.), Model TEM double screw extruder (by Toshiba Machine Co., Ltd.), extruders (by KCK Co., Ltd.), Model PCM double screw extruder (by Ikegai Tekko Co., Ltd.), Model KEX double screw extruder (by Kurimoto, Ltd.), and continuous kneaders (by Buss Co., Ltd.).

In general, the barrel of extruders utilized for the kneading is divided into plural parts, and a heating unit such as an electric heater and a cooling unit such as a cooling pipe are provided to the barrel, thereby the temperature is controlled by use of a thermal controller. Two screws are engaged within the barrel, and are rotated in a same direction at a velocity of 100 to 500 rpm. The construction of the screws may be properly selected depending on the application; for example, feeding portion and kneading portion are constructed into the screws.

The screw feeder feeds the mixture of the toner raw materials from the hopper into the region of feeding screw. The mixture is gradually heated at the region of feeding screw, then the mixture raises its temperature by internal heat built-up due to high shear stress derived by the kneading screw, which promotes the dispersion of toner raw materials, thus the mixture turns into a molten state from a solid or semi-molten state. An optional secondary kneading screw at the rear region and/or other designs of screws may bring about higher temperature, which may melt the mixture sufficiently and enhance the wetting ability between the resin and the colorant.

Preferably, plural vents for degassing the mixture are provided behind the site where the mixture melts, more preferably, the plural vents are partly or entirely vacuumed by means of a vacuum pump and the like, thereby the mixture modifies the filled condition, the dispersing ability is enhanced, and the volatiles are efficiently removed.

Single screws or double screws are typically suited to continuous extruders. The number of screw grooves may be designed from double groove, triple groove, and the like, considering the dispersing ability, productivity, kneading temperature, and the like. Preferably, the size of the extruder is selected such that the feeding region, kneading region, and plural vents are appropriately arranged. Preferably, L/D is 20 or more, and more preferably is 25 or more, wherein the inner diameter of barrel is D millimeter (mm) and the distance between the inlet of the raw materials and the outlet of the mixture is L (mm).

The mixed product is calendered by means of a calender roll and the like, and cooled by use of air, water, and the like. Then, the mixed product is gradually divided into a desired particle size such that firstly the mixed product is subjected to granulation by means of a crusher, hammer mill, feather mill, or the like, thereafter is subjected to milling by means of a milling and classifying apparatus based on collision such as a jet mill and jet atomizer. After the milling, the mixed product is subjected to classification by means of an inertia-classification elbow jet, centrifugal-classification Micro Plex, DS separator, or the like, thereby a milled-classified toner may be obtained.

When the toner includes external additives, specific amounts of additives are generally compounded to the milled-classified toner, and stirred and mixed by means of a high-share mixer such as a Henschel mixer, super mixer, or the like. Then, the mixture is subjected to screening for removing contaminants and course particles, thereby the final toner product is obtained.

In accordance with the process described above, high-image quality toners having a lower fixing temperature, fine particle size, and narrow particle size distribution can be obtained without deteriorating the productivity compared to conventional processes.

The present invention will be illustrated in more detailed with reference to examples given below, but these are not to be construed as limiting the present invention. All percentages and parts are by weight unless indicated otherwise.

EXAMPLES

Example 1-1

FIG. 4 shows an exemplary construction of a milling and classifying apparatus. As shown in FIG. 4, toner A of coarse particles to be milled was fed to injection nozzle 42 from the raw material inlet disposed at upper side of the collision mill 41. By action of high-velocity stream B ejected from nozzle 42, the toner of coarse particles flowed with stream B at a high velocity, and collided against an opposing collision plate 45 thereby was divided into fine particles. The divided particles flowed between collision-plate support 36 and the inner wall of milling room 44 and collided against collision member 38 on the way, then flowed into outlet 47.

The specifications of the milling and classifying apparatus were as follows:

Model: IDS-20

Maximum flow rate: 20 $m^3$/min

Inner diameter of milling room: 231 mm

Inner diameter of outlet: 152 mm

The specifications of the parts of collision mill and air classifier are shown in Table 1.

The collision plate, collision-plate support, and collision member are shown in FIG. 6. As shown in FIG. 6, the collision plate was constructed from plural parts.

The toner was prepared by mixing 20 parts of a styrene-acrylic resin, 80 parts of a polyester resin, 10 parts of carbon black, 4.95 parts of carnauba wax, and 2 parts of a quaternary ammonium salt by means of a super mill, then the resulting mixture was melted and kneaded by means of Model TEM double screw extruder (by Toshiba Machine Co., Ltd.). After cooling the melted and kneaded mixture to ambient temperature, the mixture was crushed by means of a hammer mill to prepare a toner of coarse particles.

The toner of coarse particles was milled and classified by means of the milling and classifying apparatus shown in FIG. 12, which is constructed from air classifier 91 and collision mill. Various evaluations were conducted with respect to the toner and the apparatus as follows. The results are shown in Table 2.

(i) Mass average particle size

The mass-average particle size was determined by means of Coulter Counter Model TAII (by Beckman Coulter Co.)

(ii) Distribution factor: Dv/Dn

From mass-average particle size Dv and number-average particle size Dn determined by the Coulter Counter, distribution factor (Dv±Dn) was calculated.

(iii) Deformation of collision member

The collision member was visually observed with respect to the deformation, after the milling and classifying apparatus was continuously operated for 100 hours for milling and classifying the toner of coarse particles.

(iv) Abrasion of collision member

The collision member was visually observed with respect to the surface abrasion, after the milling and classifying apparatus was continuously operated for 100 hours for milling and classifying the toner of coarse particles.

(v) Deposition of toner

The amount of toner deposited on the collision member was determined by way of comparing the weight of the collision member after and before the continuous operation for 100 hours.

(vi) Output rate of toner

The output rate was determined by the produced amount of the toner in the continuous operation for 100 hours.

Examples 1-2 to 1-13

Toners were produced and the evaluations were conducted in the same manner as Example 1-1, except that the milling and classifying apparatus was constructed under the specifications shown in Table 1. The results are shown in Table 1.

Comparative Example 1

A toner was produced and the evaluations were conducted in the same manner as Example 1-1, except that the milling and classifying apparatus was constructed without the collision member downstream of the collision plate. The results are shown in Table 1 summarily.

The results of Table 1 demonstrate that the milling and classifying apparatus according to the present invention can produce toners with narrower particle size distributions without reducing the output rate, namely, without deteriorating the productivity.

Example 2-1 to 2-9

A collision mill was constructed as shown in FIG. 4 in the same manner as Example 1-1, except for the specifications shown in Table 2. In Examples 2-1 to 2-9, experimental factors were radius of the collision plate R (mm), distance between the collision plate and the collision member L (mm), height of the collision member from the support, thickness of

TABLE 1

| | Ex. 1-1 | Ex. 1-2 | Ex. 1-3 | Ex. 1-4 | Ex. 1-5 | Ex. 1-6 | Ex. 1-7 | Ex. 1-8 | Ex. 1-9 | Ex. 1-10 | Ex. 1-11 | Ex. 1-12 | Ex. 1-13 | Comp. Ex. 1 |
|---|---|---|---|---|---|---|---|---|---|---|---|---|---|---|
| Radius of Collision Plate R (mm) | 65 | 65 | 65 | 65 | 65 | 65 | 65 | 65 | 65 | 65 | 65 | 65 | 65 | 65 |
| Collision Plate to Collision Member L (mm) | 3 | 115 | 50 | 3 | 3 | 3 | 3 | 3 | 3 | 3 | 50 | 3 | 50 | — |
| Collision Member Height from Support H (mm) | 3 | 3 | 3 | 55 | 15 | 3 | 3 | 3 | 3 | 3 | 3 | 15 | 15 | — |
| Thickness of Collision Member D (mm) | 2.5 | 2.5 | 2.5 | 2.5 | 2.5 | 55 | 5 | 2.5 | 2.5 | 2.5 | 2.5 | 2.5 | 5 | — |
| Surface Roughness of Collision Member (micron) | 1.83 | 1.81 | 1.81 | 1.82 | 1.80 | 1.81 | 1.83 | 1.80 | 1.34 | 1.83 | 1.81 | 1.8 | 1.34 | — |
| Mareial of Collision Member | steel | steel | steel | steel | steel | steel | steel | ceramic | steel | steel | steel | steel | ceramic | — |
| Blade Angle in Flow Stabilizer (degree) | 60 | 60 | 60 | 60 | 60 | 60 | 60 | 60 | 60 | 60 | 60 | 60 | 30 | — |
| Blade Space in Flow Stabilizer (mm) | 55 | 55 | 55 | 55 | 55 | 55 | 55 | 55 | 55 | 50 | 30 | 60 | 10 | — |
| Blade Height in Flow Stabilizer (mm) | 50 | 50 | 50 | 50 | 50 | 50 | 50 | 50 | 50 | 50 | 50 | 50 | 200 | — |
| Blade Thickness in Flow Stabilizer (mm) | 10 | 10 | 10 | 10 | 10 | 10 | 10 | 10 | 10 | 10 | 10 | 10 | 5 | — |
| Blade Width in Flow Stabilizer (mm) | 50 | 50 | 50 | 50 | 50 | 50 | 50 | 50 | 50 | 50 | 50 | 50 | 25 | — |
| Core Diameter (mm) | 95 | 95 | 95 | 95 | 95 | 95 | 95 | 95 | 95 | 95 | 95 | 95 | 95 | 95 |
| Folded Angle of Blade in Flow Stabilizer (degree) | 0 | 0 | 0 | 0 | 0 | 0 | 0 | 0 | 0 | 0 | 0 | 120 | 120 | — |
| Weight Average Particle Size (micron) | 5.45 | 5.66 | 5.35 | 5.80 | 5.21 | 5.67 | 5.24 | 5.46 | 5.42 | 5.45 | 5.35 | 5.21 | 5.05 | 6.48 |
| Distribution factor: Dv/Dn | 1.28 | 1.37 | 1.24 | 1.34 | 1.22 | 1.34 | 1.24 | 1.26 | 1.28 | 1.23 | 1.22 | 1.18 | 1.13 | 1.53 |
| Deformation of Collision Member | exist | exist | exist | exist | exist | no | no | exist | exist | exist | exist | exist | no | — |
| Abrasion of Collision Member | exist | exist | exist | exist | exist | exist | exist | no | exist | exist | exist | exist | no | — |
| Toner Deposition on Collision Member (gram) | 1.2 | 0.8 | 1.0 | 0.8 | 1.1 | 0.7 | 0.9 | 1.1 | 0.1 | 1.1 | 1.0 | 0.9 | 0.1 | — |
| Output Rate (kg/h) | 86 | 87 | 87 | 87 | 86 | 86 | 87 | 87 | 86 | 90 | 91 | 90 | 100 | 80 |

the collision member, surface roughness of the collision member, and material of the collision member. The toner utilized in Example 2-1 to 2-9 was substantially the same as that of Example 1-1.

The evaluations were performed in the same manner as Example 1-1. The results are shown in Table 2 summarily.

Comparative Example 2

A toner was produced and the evaluations were conducted in the same manner as Example 2-1, except that the milling and classifying apparatus was constructed without the collision member downstream of the collision plate. The results are shown in Table 2 summarily.

factors were blade angle, blade space, blade height, blade thickness, blade width, and folded angle of blade in the flow stabilizer. The toner utilized in Example 3-1 to 3-12 was substantially the same as that of Example 1-1.

The evaluations were performed in the same manner as Example 1-1. The results are shown in Table 3 summarily.

Comparative Example 3

A toner was produced and the evaluations were conducted in the same manner as Example 3-1, except that the air classifier was constructed without the flow stabilizer at the central suction. The results are shown in Table 3 summarily.

TABLE 2

| | Ex. 2-1 | Ex. 2-2 | Ex. 2-3 | Ex. 2-4 | Ex. 2-5 | Ex. 2-6 | Ex. 2-7 | Ex. 2-8 | Ex. 2-9 | Comp. Ex. 2 |
|---|---|---|---|---|---|---|---|---|---|---|
| Radius of Collision Plate R (mm) | 65 | 65 | 65 | 65 | 65 | 65 | 65 | 65 | 65 | 65 |
| Collision Plate to Collision Member L (mm) | 3 | 115 | 50 | 3 | 3 | 3 | 3 | 3 | 3 | — |
| Collision Member Height from Support H (mm) | 3 | 3 | 3 | 55 | 15 | 3 | 3 | 3 | 3 | — |
| Thickness of Collision Member D (mm) | 2.5 | 2.5 | 2.5 | 2.5 | 2.5 | 55 | 5 | 2.5 | 2.5 | — |
| Surface Roughness of Collision Member (micron) | 1.83 | 1.81 | 1.81 | 1.82 | 1.80 | 1.81 | 1.83 | 1.80 | 1.34 | — |
| Mareial of Collision Member | steel | steel | steel | steel | steel | steel | steel | ceramics | steel | — |
| Weight Average Particle Size (micron) | 5.52 | 5.73 | 5.42 | 5.87 | 5.28 | 5.74 | 5.31 | 5.51 | 5.49 | 6.48 |
| Distribution factor: Dv/Dn | 1.29 | 1.38 | 1.25 | 1.35 | 1.23 | 1.35 | 1.25 | 1.27 | 1.29 | 1.53 |
| Deformation of Collision Member | exist | exist | exist | exist | exist | no | no | exist | exist | — |
| Abrasion of Collision Member | exist | exist | exist | exist | exist | exist | exist | no | exist | — |
| Toner Deposition on Collision Member (gram) | 1.2 | 0.8 | 1.0 | 0.8 | 1.1 | 0.7 | 0.9 | 1.1 | 0.1 | — |

Example 3-1 to 3-12

An air classifier was constructed as shown in FIG. 9 in the same manner as Example 1-1, except for the specifications shown in Table 3. In Examples 3-1 to 3-12, experimental

TABLE 3

| | Ex. 3-1 | Ex. 3-2 | Ex. 3-3 | Ex. 3-4 | Ex. 3-5 | Ex. 3-6 | Ex. 3-7 | Ex. 3-8 | Ex. 3-9 | Ex. 3-10 | Ex. 3-11 | Ex. 3-12 | Comp. Ex. 3 |
|---|---|---|---|---|---|---|---|---|---|---|---|---|---|
| Blade Angle in Flow Stabilizer (degree) | 60 | 30 | 60 | 60 | 60 | 60 | 60 | 60 | 60 | 60 | 60 | 60 | — |
| Blade Space in Flow Stabilizer (mm) | 50 | 50 | 30 | 10 | 50 | 50 | 50 | 50 | 50 | 50 | 50 | 50 | — |
| Blade Height in Flow Stabilizer (mm) | 50 | 50 | 50 | 50 | 10 | 100 | 200 | 50 | 50 | 50 | 50 | 50 | — |
| Blade Thickness in Flow Stabilizer (mm) | 10 | 10 | 10 | 10 | 10 | 10 | 10 | 5 | 15 | 10 | 10 | 10 | — |
| Blade Width in Flow Stabilizer (mm) | 50 | 50 | 50 | 50 | 50 | 50 | 50 | 50 | 50 | 25 | 50 | 50 | — |
| Core Diameter (mm) | 95 | 95 | 95 | 95 | 95 | 95 | 95 | 95 | 95 | 95 | 110 | 95 | — |
| Folded Angle of Blade | 0 | 0 | 0 | 0 | 0 | 0 | 0 | 0 | 0 | 0 | 0 | 120 | — |

TABLE 3-continued

| | Ex. 3-1 | Ex. 3-2 | Ex. 3-3 | Ex. 3-4 | Ex. 3-5 | Ex. 3-6 | Ex. 3-7 | Ex. 3-8 | Ex. 3-9 | Ex. 3-10 | Ex. 3-11 | Ex. 3-12 | Comp. Ex. 3 |
|---|---|---|---|---|---|---|---|---|---|---|---|---|---|
| in Flow Stabilizer (degree) | | | | | | | | | | | | | |
| Distribution factor: Dv/Dn | 1.31 | 1.31 | 1.31 | 1.25 | 1.31 | 1.26 | 1.22 | 1.27 | 1.30 | 1.27 | 1.38 | 1.21 | 1.53 |
| Output Rate (kg/h) | 86 | 90 | 87 | 90 | 87 | 91 | 93 | 90 | 87 | 90 | 85 | 94 | 80 |

The results of Table 3 demonstrate that the output rate and the distribution factor in the present invention are significantly superior to those of the prior art. From the results of Table 3, it is realized that the output rate and the distribution were still more improved in Examples 3-4, 3-6 to 3-10, and 3-12 compared to Example 3-1, the output rate was still more improved in 3-2, 3-3, and 3-5, the output rate and the distribution in Example 3-11 were somewhat inferior.

Further, the flow stabilizer in Example 3-1 was mounted detachably to the apparatus, which demonstrated that the period for cleaning the air classifier was shortened by 20%.

What is claimed is:

1. A milling and classifying apparatus, comprising:

a collision mill, and an air classifier, wherein the collision mill comprises a jet nozzle configured to eject jet stream into a milling room, a path configured to feed a powder to be milled into the jet stream, and a collision plate disposed opposite to the jet nozzle, a collision member is farther mounted to a support of the collision plate at downstream of the collision plate, and the powder collides with the collision member following the collision with the collision plate, the air classifier comprises a dispersion room into which a mixture of primary air and the powder is introduced, and a classification room which is equipped with a center core at the upper side, a separator core at the lower side, and a secondary air inlet at the side wall, the classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream, wherein the flow stabilizer is equipped with plural blades on a ring pedestal for controlling the air stream and a core-adjusting ring inside the pedestal for controlling the suction pressure at the central suction of the separator core.

2. The milling and classifying apparatus according to claim 1, wherein the radius of the collision plate R (mm) and the distance from the collision plate to the collision member L (mm) satisfy the relation of $0.05<L/R<1.70$.

3. The milling and classifying apparatus according to claim 2, wherein the support of the collision plate is separable into plural parts so as to adjust the distance L (mm).

4. The milling and classifying apparatus according to claim 1, wherein the radius of the collision plate R (mm) and the height of the collision member from the support of the collision plate H (mm) satisfy the relation of $0.05<H/R<0.80$.

5. The milling and classifying apparatus according to claim 1, wherein the radius of the collision plate R (mm) and the thickness of the collision member D (mm) satisfy the relation of $0.04<D/R<0.80$.

6. The milling and classifying apparatus according to claim 1, wherein the collision member is formed of a ceramic material.

7. The milling and classifying apparatus according to claim 1, wherein the surface roughness Rmax of the collision member is 1.6 μm or less.

8. The milling and classifying apparatus according to claim 1, wherein the flow stabilizer is disposed within 500 mm from the center of the central suction.

9. The milling and classifying apparatus according to claim 1, wherein the space between the blades in the flow stabilizer is 0.1 mm to 50 mm.

10. The milling and classifying apparatus according to claim 1, wherein each blade in the flow stabilizer is folded in a perpendicular direction at a site more distant than the middle of the blade.

11. The milling and classifying apparatus according to claim 1, wherein the angle between the folded surface and an unfolded surface of the folded blades in the flow stabilizer is from 90 degrees to 180 degrees.

12. The milling and classifying apparatus according to claim 1, wherein the angle and the space of the attached blades in the flow stabilizer are adjustable by a bolt mechanism, and the height and the thickness of the blades are adjustable by exchanging detachably the blades.

13. The milling and classifying apparatus according to claim 1, wherein the inner diameter of the suction of the flow stabilizer is adjustable by exchanging detachably the core-adjusting ring.

14. The milling and classifying apparatus according to claim 1, wherein the flow stabilizer is detachably attached by a mating mechanism.

15. An air classifier, comprising:

a dispersion room into which a mixture of primary air and a powder is introduced, and a classification room which is equipped with a center core at the upper side, a separator core at the lower side, and a secondary air inlet at the side wall, wherein the classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream, wherein the flow stabilizer is equipped with plural blades on a ring pedestal for controlling the air stream and a core-adjusting ring inside the pedestal for controlling the suction pressure at the central suction of the separator core.

16. The air classifier according to claim 15, wherein the flow stabilizer is disposed within 500 mm from the center of the central suction.

17. The air classifier according to claim 15, wherein the space between the blades in the flow stabilizer is 0.1 mm to 50 mm.

18. The air classifier according to claim 15, wherein each blade in the flow stabilizer is folded in a perpendicular direction at a site more distant than the middle of the blade.

19. The air classifier according to claim 15, wherein the angle between the folded surface and an unfolded surface of the folded blades in the flow stabilizer is from 90 degrees to 180 degrees.

20. The air classifier according to claim 15, wherein the angle of the attached blades in the flow stabilizer is adjustable by a bolt mechanism.

21. The air classifier according to claim 15, wherein the space of the attached blades in the flow stabilizer is adjustable by a bolt mechanism.

22. The air classifier according to claim 15, wherein the height of the blades in the flow stabilizer is adjustable by exchanging detachably the blades.

23. The air classifier according to claim 15, wherein the thickness of the blades in the flow stabilizer is adjustable by exchanging detachably the blades.

24. The air classifier according to claim 15, wherein the width of the blades in the flow stabilizer is adjustable by exchanging detachably the blades.

25. The air classifier according to claim 15, wherein the inner diameter of the suction of the flow stabilizer is adjustable by exchanging detachably a core-adjusting ring.

26. The air classifier according to claim 15, wherein the flow stabilizer is detachably attached by a mating mechanism.

27. The air classifier according to claim 15, wherein the powder has an average particle size of 5.0 μm to 13.0 μm.

28. An apparatus for producing fine particles, comprising:

an air classifier, and at least one of grinding mills, collision mills, and air conveyors, wherein the air classifier comprises a dispersion room into which a mixture of primary air and the powder is introduced, and a classification room which is equipped with a center core at the upper side, a separator core at the lower side, and a secondary air inlet at the side wall, the classification room is disposed below the dispersion room, and the mixture of the primary air and the powder flows from the dispersion room into the classification room, and a flow stabilizer is arranged at a central suction of the separator core to control swirl stream generated within the classification room so as to centrifuge the powder into coarse particles and fine particles by action of the swirl stream, wherein the flow stabilizer is equipped with plural blades on a ring pedestal for controlling the air stream and a core-adjusting ring inside the pedestal for controlling the suction pressure at the central suction of the separator core.

* * * * *